United States Patent [19]

Hummert et al.

[11] 3,973,648

[45] Aug. 10, 1976

[54] MONITORING SYSTEM FOR ELEVATOR INSTALLATION

[75] Inventors: George T. Hummert, Oakmont; Thomas D. Moser; David M. Edison, both of Murrysville, all of Pa.; Marvin Kurland, Old Bridge, N.J.

[73] Assignee: Westinghouse Electric Corporation, Pittsburgh, Pa.

[22] Filed: Sept. 30, 1974

[21] Appl. No.: 510,821

[52] U.S. Cl. ..... 187/29 R; 340/19 R

[51] Int. Cl.[2] ..... B66B 3/00

[58] Field of Search ..... 187/29; 340/19, 20, 340/419, 420

[56] References Cited

UNITED STATES PATENTS

| | | | |
|---|---|---|---|
| 3,677,370 | 7/1972 | Devine | 340/19 X |
| 3,812,492 | 5/1974 | Gotanda | 340/420 X |
| 3,841,443 | 10/1974 | Booker | 187/29 |
| 3,851,735 | 12/1974 | Winkler et al. | 187/29 |

*Primary Examiner*—Robert K. Schaefer
*Assistant Examiner*—W. E. Duncanson, Jr.
*Attorney, Agent, or Firm*—D. R. Lackey

[57] ABSTRACT

A monitoring system for off-site monitoring, traffic study and/or trouble shooting of elevator installations. Communication between the remote monitoring site and a selected elevator installation is established via a direct dial telephone link. The remote monitoring site includes visual display means for displaying the operation of the selected elevator installation in real time, means for storing and analyzing status signals from the elevator installation, as well as for printing out the results of such an analysis, and control means for entering commands to be executed by the elevator system. In addition to observing the operation of the complete elevator installation, any combination of software and/or hardware at the elevator installation may be selectively monitored by substituting a system processor and/or simulated car controllers, both of which are located at the monitoring site, for those located at the elevator installation, and operating selected components at the elevator installation along with those at the monitoring site via the communication link. The operation of the resulting hybrid system including its response to commands initiated at the monitoring site may be displayed and/or analyzed, as desired.

11 Claims, 9 Drawing Figures

CORE MAP

| | WORD NAME | ADDRESS | BIT 11 | 10 | 9 | 8 | 7 | 6 | 5 | 4 | 3 | 2 | 1 | BIT 0 |
|---|---|---|---|---|---|---|---|---|---|---|---|---|---|---|
| CORRIDOR & CAR CALLS | CL 000 | 0 1111 0000 0000 | | | UC 000 | DC 000 | | | | | CC 000 (CAR D) | CC 000 (CAR C) | CC 000 (CAR B) | CC 000 (CAR A) |
| | CL 001 | 0000 0001 | | | UC 001 | DC 001 | | | | | CC 001 (D) | CC 001 (C) | CC 001 (B) | CC 001 (A) |
| | CL 002 | 0000 0010 | | | UC 002 | DC 002 | | | | | CC 002 (D) | CC 002 (C) | CC 002 (B) | CC 002 (A) |
| | | | | | | | | | | | | | | |
| | CL 125 | 0111 1101 | | | UC 125 | DC 125 | | | | | CC 125 | CC 125 | CC 125 | CC 125 |
| | CL 126 | 0111 1110 | | | UC 126 | DC 126 | | | | | CC 126 | CC 126 | CC 126 | CC 126 |
| | CL 127 | 0111 1111 | | | UC 127 | DC 127 | | | | | CC 127 (D) | CC 127 (C) | CC 127 (B) | CC 127 (A) |
| CAR SIGNALS CAR A | IWO-CA | 0 1111 1001 0000 | AVAS | | $\overline{32L}$ | DRCL | CCBL | CCAB | CALL | UPSV | UPTR | $\overline{INSC}$ | BYPS | SLDN |
| | IW1-CA | 1010 0000 | AVP6 | AVP5 | AVP4 | AVP3 | AVP2 | AVP1 | AVPO | | | | | |
| | IW2-CA | 1011 0000 | | | | | | | | | $\overline{WT75}$ | $\overline{WT50}$ | CREG | ATSV |
| | ØWO-CA | 1000 1101 | FAD6 | FAD5 | FAD4 | FAD3 | FAD2 | FAD1 | FADO | SASS | TASS | MØD1 | MØDO | $\overline{PARK}$ |
| | ØW1-CA | 1001 1101 | | | HLM1 | HLMO | | | $\overline{DCLØ}$ | $\overline{DOPN}$ | $\overline{CCAI}$ | $\overline{MCCR}$ | $\overline{INUP}$ | $\overline{BSMT}$ |
| | ØW2-CA | 1010 1101 | | | | | | $\overline{STT}$ | $\overline{MNFL}$ | $\overline{NEXT}$ | $\overline{AVAD}$ | | | |
| CAR SIGNALS CAR B | IWO-CB | 1001 0010 | | | | | | | | | | | | |
| | IW1-CB | 1010 0010 | | | | | | | | | | | | |
| | IW2-CB | 1011 0010 | | | | (SAME AS CAR A) | | | | | | | | |
| | ØWO-CB | 1000 1111 | | | | | | | | | | | | |
| | ØW1-CB | 1001 1111 | | | | | | | | | | | | |
| | ØW2-CB | 1010 1111 | | | | | | | | | | | | |

REMAINING CARS OF BANK

FIG. 3

MONITORING SYSTEM FOR ELEVATOR INSTALLATION

BACKGROUND OF THE INVENTION

1. Field of the Invention

The invention relates in general to elevator systems, and more specifically to monitoring systems for remotely monitoring and exercising elevator installations.

2. Description of the Prior Art

The elevator cars of a bank of elevator cars in medium and high speed elevator systems are usually controlled by a system processor which directs the operation of a plurality of elevator cars to answer calls for elevator service according to a predetermined strategy. For many years, the system processor was of the hard-wired relay type, but with the development of reliable solid state control devices, the relay system processors are being replaced by solid state logic control devices, as well as by programmable type dispatchers which include a digital computer and software package.

Regardless of the type of system processor, the individual car performance as well as the overall system operation should be periodically checked as part of a preventive maintenance program. Maintenance personnel should periodically check the individual cars to insure that they level to within the prescribed limits prior to full door openings, and that doors operate properly, opening and closing at the proper speed and remaining open for the desired non-interference time. Other important items should also be checked, such as whether or not the car properly becomes available for assignment by the system processor when the elevator car is not busy. Also, it is important to know whether or not the elevator car being checked has been intermittently going out of service.

In addition to checking each elevator car, maintenance personnel should also check system operation, to insure that all of the features of the strategy are functional. Stop watch timing is now used to check average waiting time for hall call service, floor-to-floor time, and average round trip time for a car leaving the main floor. The frequency of by-passing of the cars due to full-loads should also be determined.

Machine room checks of the drive motors should also be made, checking such items as motor bearing vibration and temperature, armature current, and armature brush wear.

It will be realized that intermittent faults will not easily be observed by the maintenance personnel, and that it is very difficult for them to conduct an accurate traffic study to determine if the system processor is operating properly and providing all of the functions that it was designed for. It is even more difficult to reduce stop watch timing data to meaningful data, such as mean waiting and round trip times.

Since it is highly desirable that actual out of service time for an elevator car, or a bank of elevator cars, be kept to an absolute minimum, an elevator trouble reporting system has been disclosed in U.S. Pat. 3,209,324 which automatically reports a fault or safety device operation to a selected central office location. The fault or safety device operates a trouble reporting device which selects one of a plurality of pre-recorded tape messages to transmit to the central location. This arrangement facilitates prompt service for an actual fault or safety device operation, and thus reduces out of service time by promptly reporting the type of fault or safety device which operated.

SUMMARY OF THE INVENTION

Briefly, the present invention is a new and improved monitoring system for elevators which permits access to an elevator installation from a remote point via a direct dial telephone link. When a selected elevator system is to be monitored, the telephone number of the system is dialed, and the elevator system starts sending serial digital signals to the remote monitoring point, which signals indicate the present status of the elevator system.

The remote monitoring point, which may be the central office of a service organization which has the responsibility of servicing the elevator installation, includes means for processing the serial, digital information. The processing means decodes the information and presents it to the operating personnel in a usuable form. For example, the information may be displayed on a display panel which optically displays the operation of the elevator system in real time, showing car position, movement of the cars, car calls, hall calls, and a plurality of other status signals such as signals which indicate (a) when the car is available for assignment, (b) the service and travel directions of each car, (c) the positions of the car doors, and (d) the loading of each car. Registers may be accessed which, for example, may indicate whether a car has made a poor landing since the elevator system was last interrogated, and the actual nuumber of such out of range landings may be displayed in binary by using a plurality of lamps. The condition of transducers may also be indicated on the display, such as transducers responsive to bearing vibration and temperature, brush length, armature current, and the like.

In addition to the optical display, or as an alternative thereto, the processing means may include the logic necessary to provide traffic studies, timing predetermined functions and then calculating and printing out average wait time for hall calls, round trip times for the cars, floor-to-floor times, door open times and the like.

Further, the new and improved monitoring system includes provisions for actually exercising the elevator system. Car and hall calls, as well as parking commands, may be selectively placed by operating personnel over the communication link, and the response of the elevator system to such calls may be observed. Of course, the exercising of the system would take place when the building is normally unoccupied, and the elevator cars are not being used. Such exercising and monitoring of the elevator system may occur automatically, with successive automatic dialing of elevator installations during a time when the associated buildings are unoccupied, such as after 12 midnight. The response of the elevator system being monitored to a predetermined pattern of calls automatically placed by the monitoring system may be stored on tape for later display and/or analysis. Or, the elevator system response may be immediately evaluated and the results of the evaluation printed for later use by maintenance personnel. The pattern of traffic requests and commands automatically sent from the central monitoring office to each elevator installation would be designed to check the various strategy functions of the associated elevator system processor, as well as the condition of the individual car controller and the mechanical devices associated with each elevator car. In other words, the off-site maintenance system provides the capability for automated, off-site real time traffic studies and system diagnostics.

Still further, selected portions of an elevator system may be individually monitored. For example, the monitoring site may include a system processor similar to the system processor which is located at the elevator installation, and the monitoring site may also include simulator apparatus for simulating the response of elevator cars to commands initiated by the system processor. The system processor located at the central monitoring site may be substituted for the system processor located at the elevator installation, and the elevator cars exercised by the remote system processor over the communication link. Switching back and forth between the local and remote system processor provides a direct comparison of the response of the elevator system to two identical traffic conditions entered from the remote monitoring point, to accurately check the functioning of the system processor located at the elevator installation. Also, the system processor located at the elevator installation lation may be checked without actually operating the elevator cars, by connecting the system processor at the elevator installation with a car control simulator at the central monitoring site. The response of the cars, as provided by the simulator, responsive to commands prepared by the elevator system processor, may be observed, and thus the various functions and strategies of the elevator system processor may be systematically checked by entering predetermined traffic patterns from the central monitoring office.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIG. 3 illustrates an exemplary core map for the memory of a programmable system processor which may be used for the system processor shown in block form in FIG. 1, as well as for the system processor which is part of the elevator system to be monitored;

DESCRIPTION OF THE PREFERRED EMBODIMENTS

Figure 1:
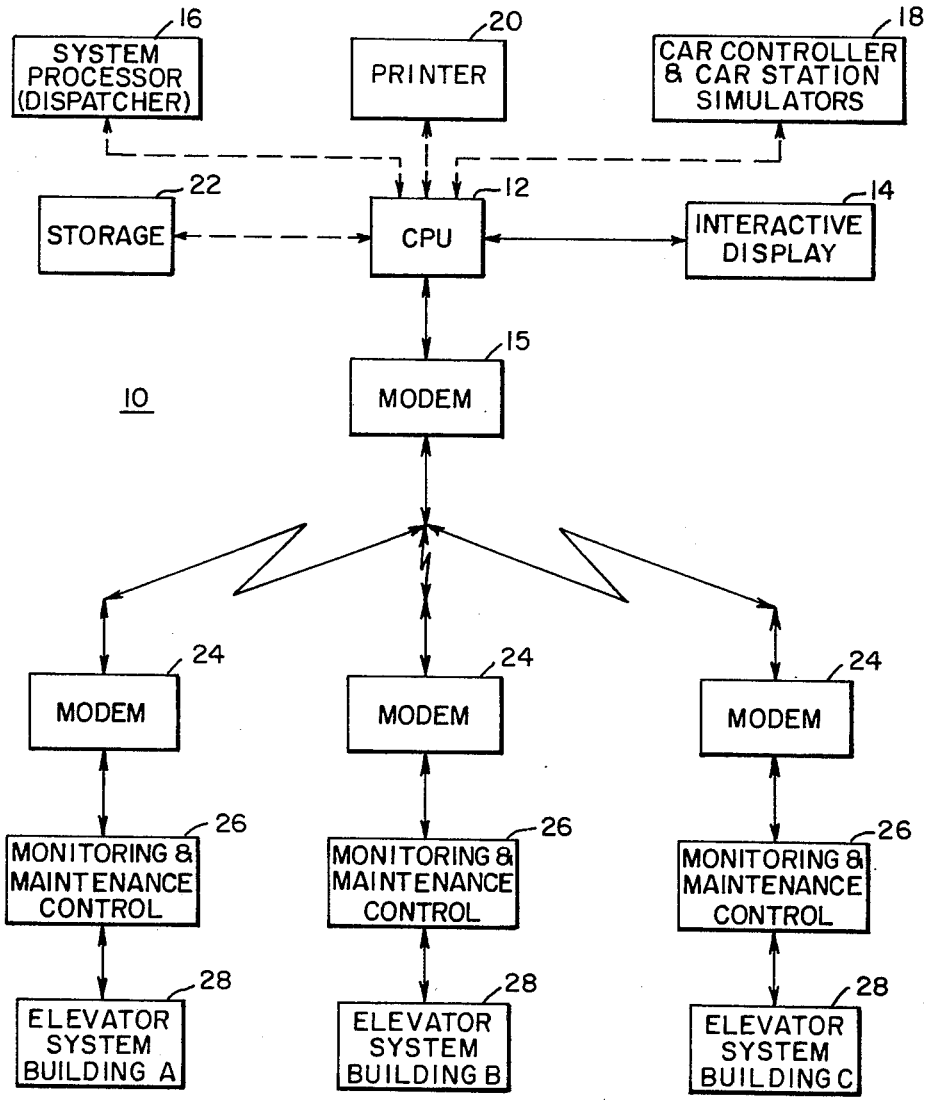
FIG. 1 is a block diagram of a monitoring system for elevators constructed according to the teachings of the invention.
Figure 2:
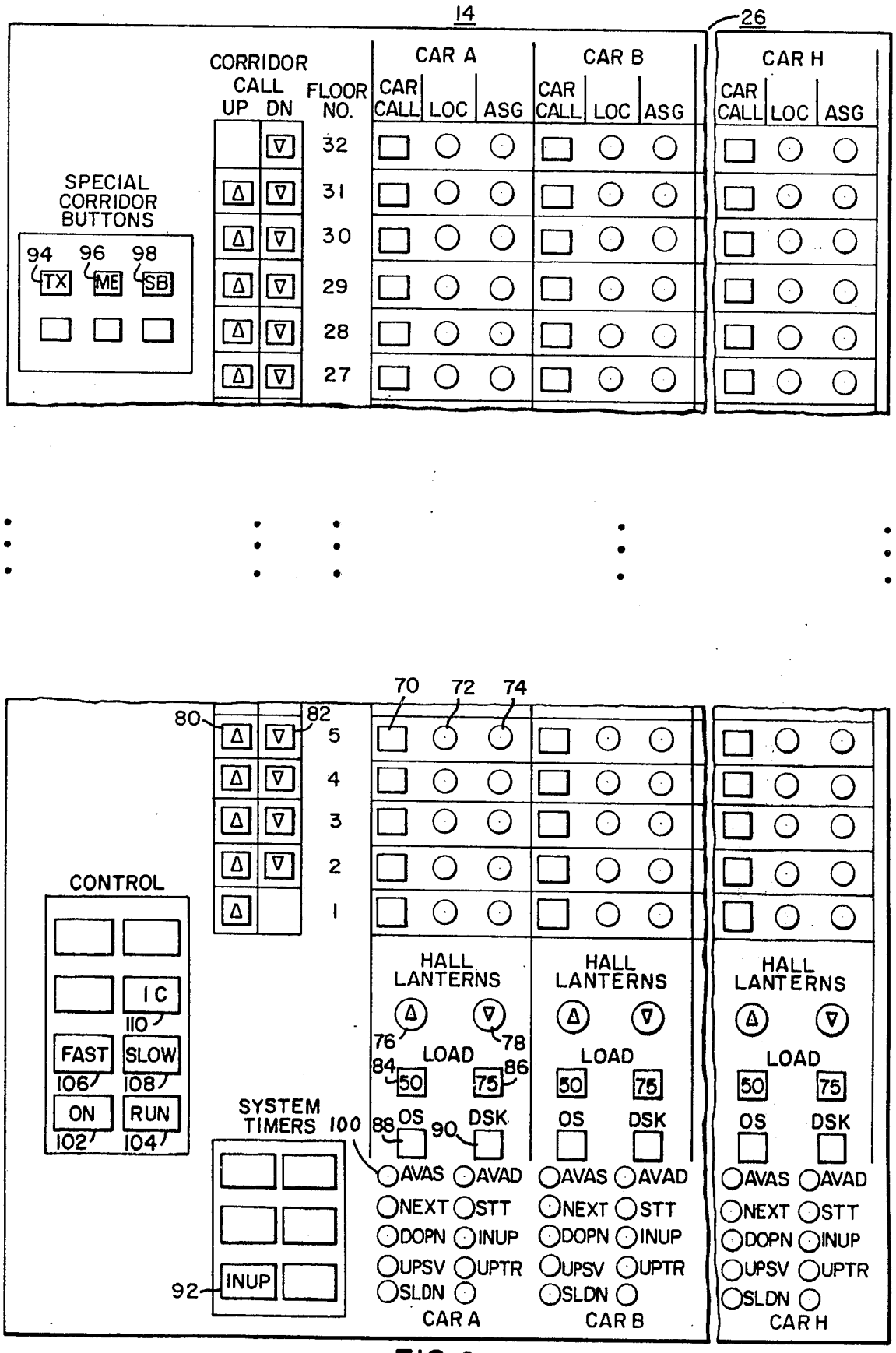
FIG. 2 is a fragmentary view of the face of an interactive display panel shown in block form in FIG. 1.

Referring now to the drawings, and FIG. 1 in particular, there is shown a block diagram of an elevator monitoring system 10 constructed according to the teachings of the invention. The monitoring system 10 includes, at a point remote from the elevator installation, or installations to be monitored, a central processing unit 12, an interactive display panel 14 and a modem 15. In various embodiments of the monitoring system 10, additional apparatus may be provided, such as a system processor or dispatcher 16, car controller and car station simulator 18, a printer 20 and storage means 22. This remotely located portion of the monitoring system 10 is substantially as described in co-pending application Ser. No. 510,940, entitled "Elevator Bank Simulation System," which is assigned to the same assignee as the present application and filed concurrently with this application in the names of G. T. Hummert, T. D. Moser, and D. M. Edison. For brevity in describing the new and improved monitoring system for elevators, the disclosure of this co-pending application is hereby incorporated into the present application by reference. FIGS. 2 and 3 of this application correspond to FIGS. 4 and 3, respectively, of the incorporated application, and are presented in the present application for convenience. FIG. 2 is a fragmentary view of the face of the interactive display 14, and FIG. 3 is an exemplary core map of the system processor 16. As will later be observed, FIG. 13 is also an exemplary core map of a system processor which may be used in an elevator system to be monitored.

The remotely located portion of monitoring system 10 includes a communication link with an elevator installation to be monitored, which is initiated by a modem 15. For purposes of example, three elevator systems are indicated as being selectively accessible by the remotely located portion of the monitoring system, but any number may be accessed by the remote portion of a monitoring means. Each elevator system to be monitored includes a modem 24, a monitoring and maintenance control function 26 and an elevator installation 28, which includes at least one elevator car, and usually will include a plurality of cars under the control of a system processor or dispatcher. The elevator system 28 to be monitored may be of the relay type, the solid state type, or of the solid state programmable dispatcher type. For purposes of example, it will be assumed that the elevator system is of the solid state programmable dispatcher type completely described in the following patents and patent applications, all of which are assigned to the same assignee of the present application, which, along with the hereinbefore co-pending application, are hereby incorporated into the present application by reference:

1. U.S. Pat. No. 3,750,850 issued Aug. 7, 1973 to C. L. Winkler et al, entitled "Floor Selector For An Elevator System,"
2. U.S. Pat. No. 3,804,209 issued April 16, 1974 to D. Edison, entitled "Elevator System," and
3. Application Ser. No. 340,615 filed Mar. 12, 1973 in the name of M. Sackin, entitled "Elevator System", which issued as U.S. Pat. 3,851,734 on Dec. 3, 1974.

U.S. Pat. No. 3,750,850 discloses a floor selector and other car control for operating a single elevator car. U.S. Pat. No. 3,804,209 discloses the modifications necessary to the single car control, and interface functions, for operating a plurality of elevator cars with a programmable dispatcher. U.S. Pat. No. 3,851,734 discloses a programmable dispatcher which provides assignments for a plurality of elevator cars in response to status signals received from the car controllers of the various cars and traffic requests from the hall call control.

The display panel 14 includes means for initiating traffic requests, i.e., car and hall calls, means for initating special system strategies, means for setting predetermined car status signals, means for initiating predetermined display panel operating modes, and indicating means, such as illuminable display devices.

FIG. 2 is an elevational view of the operating face of display panel 14, which illustrates suitable devices for performing the above mentioned functions. Before describing the display panel 14, however, it will be helpful to describe the core map shown in FIG. 3, as the core map sets forth certain signals which will be referred to when describing the display panel 14.

The system processor 16 contains certain tables in its memory, which tables list the car assignment words OWO, OW1, and OW2, the car status words IWO, IW1 and IW2, and traffic requests (car and hall calls). The core map of FIG. 3 gives, by way of example, the locations of these tables in the memory of the system processor 16, as well as in the memory of a system processor associated with an actual elevator installation.

The first 128 addresses of the core map shown in FIG. 3, only 6 of which are shown, are for traffic requests, i.e., car and hall calls. This map illustrates a table for up to 128 floors, and for fewer floors the memory space may be reduced accordingly. The car and hall call word CL is followed by the basic scan slot number of each word. For example, word CL000 refers to scan slot zero, and it will contain call information relative to the floor level associated with scan slot zero. Car calls for up to 8 cars are arranged in bits 0–7 of each call word, and down and up hall calls are arranged in bits 8 and 9, respectively. Thus a car call in car A for scan slot 002, which may be associated, for example, with floor number 2, would appear in bit 0 of word CL002 at memory address 0000010, since bit zero is assigned to car A.

The car signals for car A, i.e., words IW0, IW1, IW2, OW0, OW1 and OW2 appear at the addresses listed in FIG. 3, with the bit location of the word in the memory being as illustrated. The signals for the remaining cars are then listed. Words IW0, IW1 and IW2 are status words for each elevator car, which words are normally provided by the car controllers of the various cars for the dispatcher control.

The signals and their description included in each status word are listed below:

STATUS WORD IWO

| SIGNAL | DESCRIPTION |
|---|---|
| SLDN | Car is in slowdown phase of run |
| BYPS | Car is bypassing corridor calls |
| $\overline{\text{INSC}}$ | Car is in-service with dispatcher control |
| UPTR | True (logic one) when car is set for up travel |
| UPSV | True when car is set for up service |
| CALL | A car call is registered |
| CCAB | A car call above the advanced car position is registered |
| CCBL | A car call below the advanced car position is registered |
| DRCL | True when all doors are closed |
| $\overline{\text{32L}}$ | True (logic zero) when car is moving |
| AVAS | Car is available according to the floor selector |

STATUS WORD IW1

| | |
|---|---|
| A VPO-AVP6 | Advanced car position in binary |

STATUS WORD IW2

| | |
|---|---|
| ATSV | Car on attendant service |
| CREG | Car call is registered |
| $\overline{\text{WT50}}$ | Car load is greater than 50% of capacity |

-continued

STATUS WORD IWO

| SIGNAL | DESCRIPTION |
|---|---|
| $\overline{\text{WT75}}$ | Car load is greater than 75% of capacity |

Words OW0, OW1 and OW2 are assignment words, prepared for each elevator car by the dispatcher control 16 in response to the traffic requests and a logic arrangement which considers the car status words.

The symbols and their description included in the car assignment words for each car are listed below:

ASSIGNMENT WORD OW0

| SIGNAL | DESCRIPTION |
|---|---|
| $\overline{\text{PARK}}$ | Park command from dispatcher |
| MODO and MOD1 | Bits which select 1 of 4 floor address modes |
| TASS | Travel assignment - one = up, zero = down |
| SASS | Service assignment - one = up, zero = down |
| FADO-FAD6 | Floor address in Binary |

ASSIGNMENT WORD OW1

| SIGNAL | DESCRIPTION |
|---|---|
| $\overline{\text{BSMT}}$ | Basement assignment |
| $\overline{\text{INUP}}$ | A traffic pattern mode initiated by heavy up traffic |
| $\overline{\text{MCCR}}$ | Master car call reset |
| $\overline{\text{CCAI}}$ | Inhibits car calls from being answered |
| $\overline{\text{DOPN}}$ | Dispatcher command to open car doors |
| $\overline{\text{DCLO}}$ | Dispatcher command to close car doors |
| HLMO and HLM1 | Bits which select 1 of 4 Hall Lantern Modes |

ASSIGNMENT WORD OW2

| | |
|---|---|
| $\overline{\text{AVAD}}$ | The car is available according to the dispatcher control |
| $\overline{\text{NEXT}}$ | Car is next to leave the main floor |
| $\overline{\text{MNFL}}$ | Main floor start signal from dispatcher control |
| $\overline{\text{STT}}$ | Special through trip |

The call words, CL as well as the car signal words IW0-IW2 and OW0-OW2 may be placed in the memory of the dispatcher 16, or retrieved therefrom, via a direct memory access channel between the dispatcher 16 and the central processor 12, if desired.

Returning now to the display panel 14 shown in FIG. 2, there are 32 floor levels marked 1 through 32, and information for up to and including 8 cars is provided. Since the information relative to each car is similar, a vertical section of the panel through the per car information is removed in order to compress the size of the panel and to simplify the drawing. Certain of the control devices on the display panel 14 are only applicable when the car controller and car station simulators 18 are operable.

The devices having the square configurations shown on the face of panel 14 indicate illuminable pushbuttons, while the devices having the circular configuration indicate illuminable devices, such as lamps.

The information relative to each elevator car appears in vertical columns between the legends or headings set forth on the face of the display which identifies the car. For example, the information relative to car A appears between the vertically spaced headings "Car A-Car A." Since the information for each car is similar, only the information relative to car A will be described in detail.

The vertical spacing between the headings for car A is divided into 40 rows, with the upper 32 rows pertaining to floor related information. These 32 rows are identified by the numbers 1 through 32 which appear under the legend "Floor No.". The per floor information is divided into three categories which indicate:

1. If the car has a car call for that floor
2. If the advanced car position is currently at that floor
3. If this floor is included in the assignment given to this car by the system processor.

These three bits of information respectively appear in the first, second and third vertical columns headed "CAR CALL", "LOC" and "ASG", which legends are located immediately below the car identification legend. The first vertical column headed car call includes 32 illuminable pushbuttons, one for each of the 32 floor levels, such as pushbutton 70 for floor level 5. Car calls for car A for any of the 32 floors may be entered by depressing the desired pushbutton, or pushbuttons.

The second vertical column, i.e., the column headed LOC includes a lamp for each floor level and identifies the floor of the advanced car position. When the car is stopped at a floor, the actual and advanced car positions are the same, and a lamp in this column associated with the floor level at which the car is stopped will be illuminated. For example, when the car is stopped at the fifth level, lamp 72 will be illuminated. When the elevator car is moving, the advanced car position will be ahead of the actual car position by a number of floors determined by the car speed and the spacing between the floors. The lamp illuminated when the car is moving indicates the floor at which the elevator car could make a normal stop if it were to be requested to make a stop. As the advanced car position changes, the lamps will be turned on and off to indicate the movement of the elevator car through the building.

The third column, i.e., the column headed "ASG", includes a lamp for each floor level, which lamps identify the floors included in the assignment given to the associated car by the system processor of the elevator system. For example, if floor level 5 is included in the car's assignment, lamp 74 will be illuminated. When an elevator car is not under control of the system processor of the elevator system, it automatically goes on through trip operation. On through trip, a car will consider all down hall calls ahead of its travel direction when set for down travel (UPTR = 0), and when there are no down calls it will travel to the lowest registered up call in the building and reverse its travel direction at this call. It will then consider all up hall calls ahead of its upward travel direction. When there are no further up hall calls it will reverse at the highest registered down hall call and will again consider down hall calls ahead of its travel direction. When the elevator car is not in-service with the system processor (INSC = 0), the lamps will be illuminated for the various floors according to the floors at which the elevator car could see hall calls if they existed, according to the pattern just set forth.

When the elevator car is in-service with the system processor (INSC = 1), the system processor controls the floors from which the elevator car can consider hall calls. The dispatcher control provides assignments by selecting a floor address, which is set forth in signal FADO-FAD6, and then setting the floor address mode bits MODO and MOD1 to interpret the floor command according to the following truth table shown in Table I.

TABLE I

TRUTH TABLE FOR ASSIGNMENT MODE BITS

| MODO | MOD1 | Floors from which the elevator car can see corridor calls |
|---|---|---|
| 0 | 0 | None |
| 1 | 0 | Only FADO-FAD6 Floor |
| 0 | 1 | FADO-FAD6 Floor and Above |
| 1 | 1 | FADO-FAD6 Floor and Below |

The service assignment signal SASS from the system processor sets the car for up service (UPSV = 1) or down service (UPSV = 0), which determines the service direction of the hall calls which can be considered from the floors enabled by the system processor. Thus, if an elevator car is inhibited from seeing all hall calls, none of the lamps under the column ASG will be illuminated. If an elevator car is given a single floor assignment, only the lamp associated with the floor defined by the address FADO-FAD6 will be illuminated. The service direction of the floor call which can be considered from this floor is noted by first and second lamps 76 and 78, respectively, disposed in a row below the row associated with floor level 1, which row has the legend "Hall Lanterns". If the car has an up service assignment (SASS = 1), hall lantern indicator or lamp 76 will be illuminated, while if the car has a down service assignment, hall lantern indicator 78 will be illuminated. This is the normal mode for the hall lanterns, indicated by the hall lantern mode bits HLMO and HLM1 both being a logic one. If the dispatcher 24 desires, this normal hall lantern mode may be overridden to implement certain strategies, according to Table II, which is a truth table for the Hall Lantern mode bits.

TABLE II

TRUTH TABLE FOR HALL LANTERN MODE BITS

| HLM1 | HLMO | Definition |
|---|---|---|
| 1 | 1 | Normal Operation |
| 0 | 0 | Inhibit illumination of both lanterns |
| 1 | 0 | Turn on down hall lantern |
| 0 | 1 | Turn on up hall lantern |

Hall or corridor calls may be introduced into the monitored elevator system by first and second vertical columns containing illuminable pushbuttons collectively headed by the legend "CORRIDOR CALL", and individually headed by the legends "UP" and "DN", respectively. The first column includes a pushbutton associated with levels 1 through 31, and the second column includes pushbuttons associated with levels 2 through 32. If the operator desires to enter an up hall call for the fifth level, pushbutton 80 would be actuated. In like manner, if the user wishes to enter a down hall call for the fifth floor, pushbutton 82 would be actuated.

The means for setting predetermined car status signals include the illuminable pushbuttons 84, 86, 88 and 90. Pushbuttons 84 and 86 are disposed in a row headed by the legend "LOAD" with pushbutton 84 including the specific legend "50" and pushbutton 86 including the specific legend "75". These pushbuttons may be actuated by the user to indicate specific car loads, with pushbuttons 84 and 86 corresponding to the car status signals $\overline{WT50}$ and $\overline{Wt75}$, respectively. If the user wishes to set signal $\overline{WT50}$ true (i.e., logic zero), indicating that the load in the car is 50% or greater, compared with its capacity, pushbutton 84 would be actuated. In like manner, the user may set signal $\overline{WT75}$ to the true state, indicating a car load of 75% or greater, by actuating pushbutton 86.

Pushbutton 88 is headed by the legend "OS", which button, when actuated takes the car out of service, and the car is not considerd by the system processor when making assignments. Pushbutton 90 is headed by the legend "DSK", which button, when actuated indicates to the system processor that the doors on this car are stuck. The response of the strategy of this malfunction can then be observed. Additional pushbuttons may be provided to set other car status signals or conditions, or those shown may be assigned different functions than those described, if desired.

The means for initiating special system strategies features such as those which are often offered as optional items. Optional features, for example, are special basement strategies, convention floor features, night service feature, mid-building return (parking) and intense-up. These and/or other features may be added by actuating an appropriate illuminable pushbutton from those grouped under the legend "system timers". For purposes of example, only the intense-up feature is illustrated, which feature may be added to the strategy of the dispatcher 16 by actuating pushbutton 92. When the intense-up pushbotton 92 is illuminated, an elevator car leaving the main floor with 50% load, or greater, will place the bank of cars on intense-up traffic by a timer. While this timer is actuated, the dispatcher strategy will be modified in a predetermined manner, such as by dividing the bank of cars into low and high zone cars, with high zone cars leaving the main floor responding to car calls for the high zone only, at least until the car makes its first stop for a hall call.

Special hall or corridor calls may be entered into the elevator system by the illuminable pushbuttons grouped under the general legend "SPECIAL CORRIDOR BUTTONS". For example, pushbuttons 94, 96 and 98 which include the individual legends "TX", "ME" and "SB", respectively, may represent pushbuttons at the main floor for service to a top extension, to a middle extension, and to sub-basement floors, respectively.

In addition to the per car signals listed in the vertical columns associated with each car, a plurality of additional lamps, such as lamps 100, may be included to indicate when certain status and command signals are true. An illuminated lamp indicates to the user that the signal set forth by the associated legend is true. For purposes of example, indicating lamps are provided for status and command signals AVAS, AVAD, NEXT, STT, DOPN, INUP, UPSV, UPTR and SLDN.

Various display panel operating modes are controlled by a plurality of illuminable pushbuttons grouped under the legend "CONTROL". For purposes of example, pushbuttons 102, 104, 106, 108 and 110 are given the specific legends "ON", "RUN", "FAST", "SLOW" and "IC", respectively. Buttons FAST, SLOW and IC are only applicable when the simulator function 18 is active.

When a communication link is established between the remote central monitoring office and a selected elevator installation, the display panel displays in real time the operation of the monitored bank of elevator cars as the elevator cars go about their assignments to service actual traffic requests. Traffic requests and car status signals may be remotely entered into the actual elevator system at any time while the display is operating, by actuating the appropriate pushbutton. This exercising of the elevator system, which is activated through the display panel, will generally only be used when the elevator cars would be otherwise idle.

In addition to displaying the operation of the monitored elevator system, or as an alternative thereto, the processing unit 12 may be programmed to process the information received from the monitored elevator system, such as timing predetermined functions and then printing out on a printer 20 information valuable for a traffic study, such as the means or average waiting time for hall calls, as well as round trip time, and floor-to-floor time.

Figure 4:
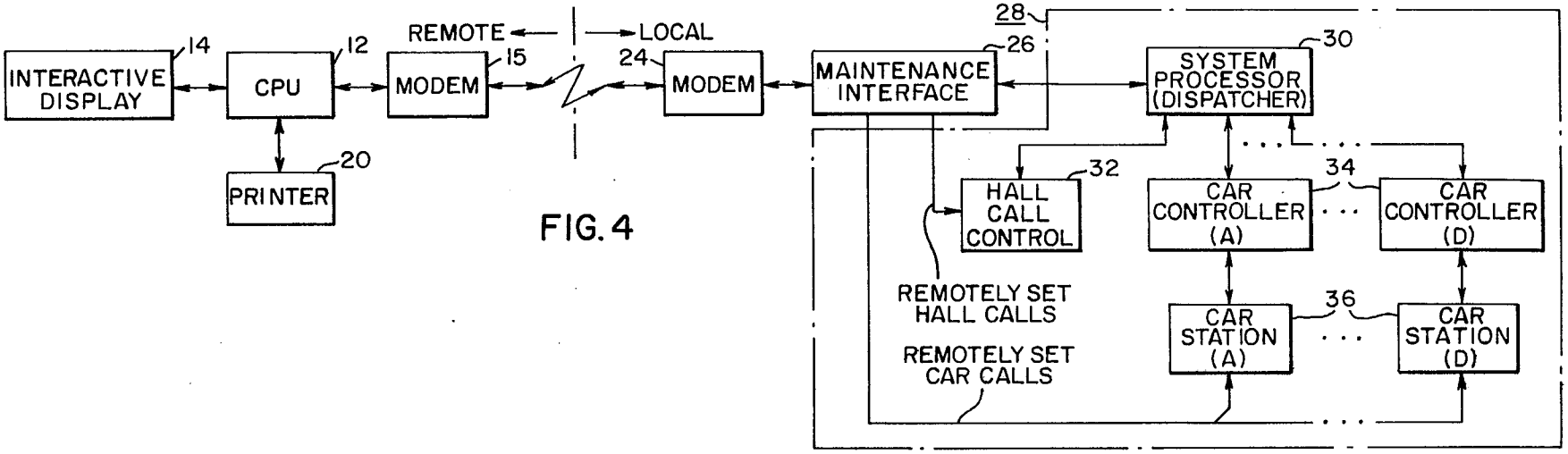
FIGS. 4, 5 and 6 are block diagrams which illustrate different operating arrangements for a monitoring system constructed according to the teachings of the invention.
Figure 5:
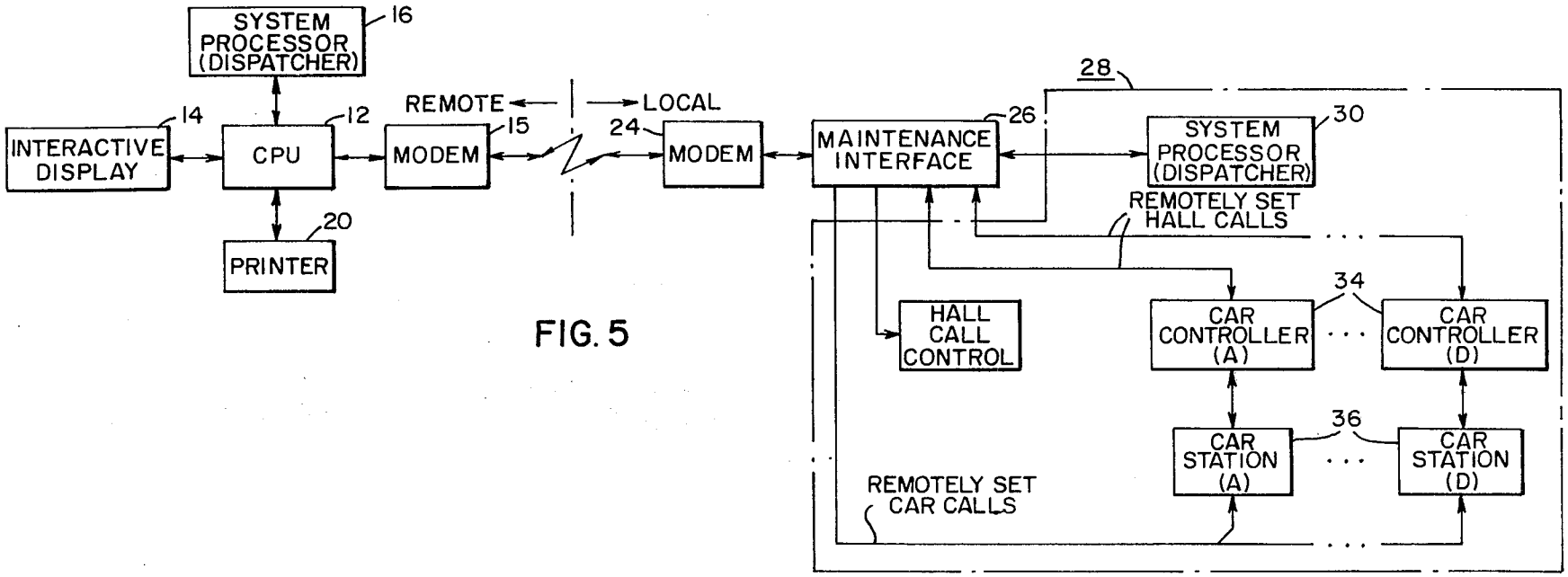
Figure 6:
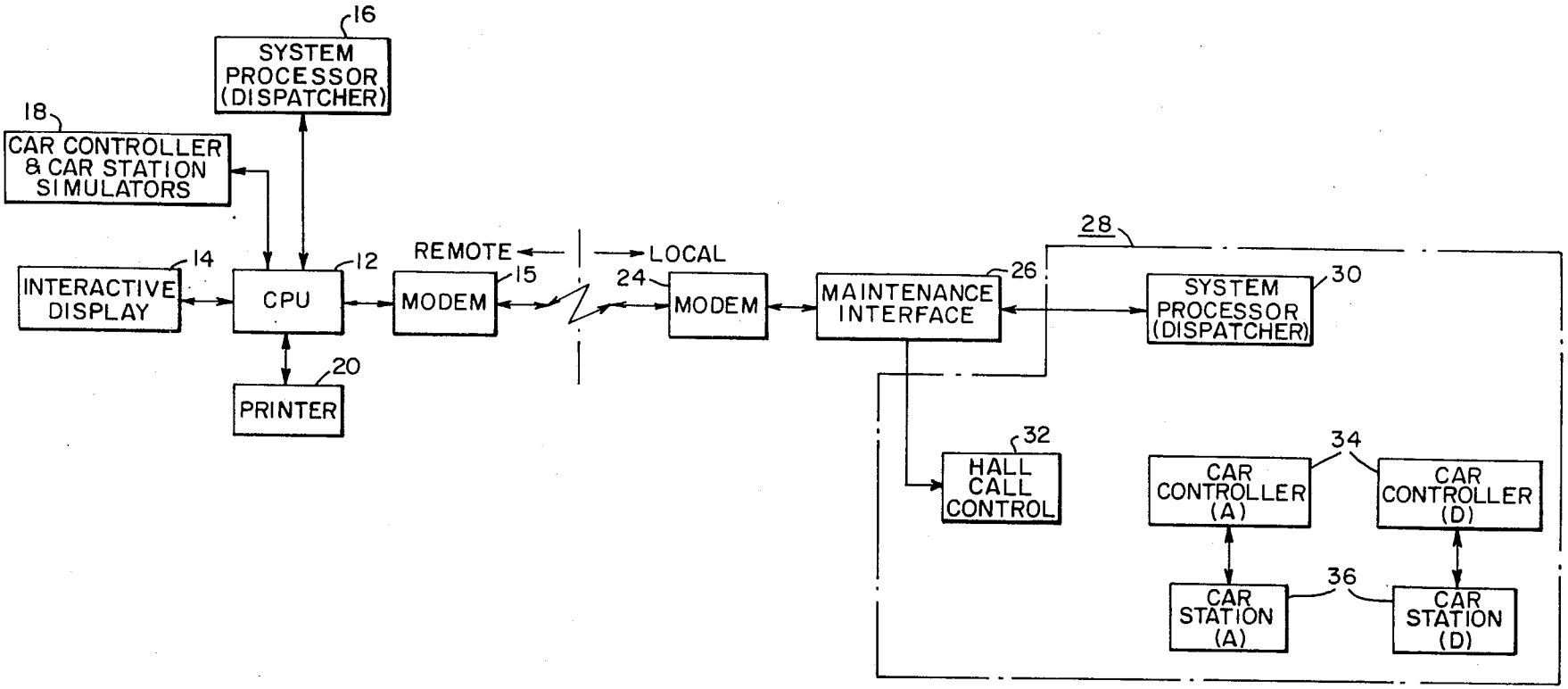

FIGS. 4, 5 and 6 are block diagrams which illustrate different embodiments of the invention. Each of the elevator systems 28 shown in FIG. 1, such as illustrated in FIGS. 4, 5 and 6, include a system processor or dispatcher 30, of which FIG. 3 is a core map, and hall call control 32. Each of the elevator cars of the elevator system includes a car controller 34 and a car station 36. The car calls originate in the car station 36, located in the elevator car, which calls are sent to its associated car control located in the penthouse. The hall calls are processed in hall call control 32 and sent to the system processor 30. The system processor 30 then prepares assignments for the various elevator cars, to direct the movements of the elevator cars as they go about the task of answering the hall calls.

In the embodiment of the invention shown in FIG. 4, the elevator installation 28 is dialed from the remote central monitoring location and the maintenance interface 26 reads the information in the memory of the system processor 30, such as via a direct memory access channel. The information read includes that shown in core map of FIG. 3. The maintenance interface 26 serializes the status information forming serial, digital data words and sends this information to the central monitoring location via the modems 24 and 15. The central processor 12 processes the information received, by decoding it and presenting it in a predetermined useful form. For example, it may be analyzed according to a predetermined program and the results printed out, and/or it may be displayed in real time on the display panel 14. If desired, the information may be stored in storage means 22 shown in FIG. 1, such as on magnetic tape, for later display and/or analysis by the processor 12.

The FIG. 4 embodiment also enables commands for the elevator system to be entered on the display panel 14, which demands are sent to the elevator system 28 via the communication link, and the system may be observed and the data analyzed to present it in the desired form. Thus, traffic studies may be accurately made from a remote location, and the operation of the system may be periodically monitored to insure proper operation of all of the components of the system. This approach allows preventive maintenance, as it detects malfunctions before they reach the failure stage, permitting maintenance personnel to be sent to the site before an actual service outage occurs.

The FIG. 5 embodiment adds the system processor 16 to the remote monitoring location, which processor will be initialized to conform to the parameters and building configuration of the elevator system to be monitored. In this embodiment, the establishment of a communication link between the monitoring site and an elevator installation inhibits the system processor 30 of the elevator installation, and the car controllers of the elevator installation communicate directly with the system processor 16 over the communication link. Thus, the car controllers and car stations may be checked separately from the system processor 30. The system processor 30 may be checked in this embodiment, by comparison with the system processor 16, by entering a predetermined traffic condition and observing the operation of the system, first using the system processor 30 and then using the system processor 16. This embodiment also permits an elevator system to operate with a remote system processor when its own system processor malfunctions.

The FIG. 6 embodiment adds the car controller and car station simulators 18, which are initialized to conform to the speed and acceleration characteristics of the actual elevator system. In this embodiment, the car controllers are removed from control by the system processor 30, and the system processor 30 communicates directly with the simulator 18 over the communication link. This embodiment checks the system processor 30, and, again, control may be switched back and forth between system processor 30 and the system processor 16, if desired, for direct comparison in handling identical traffic conditions.

Figure 7:
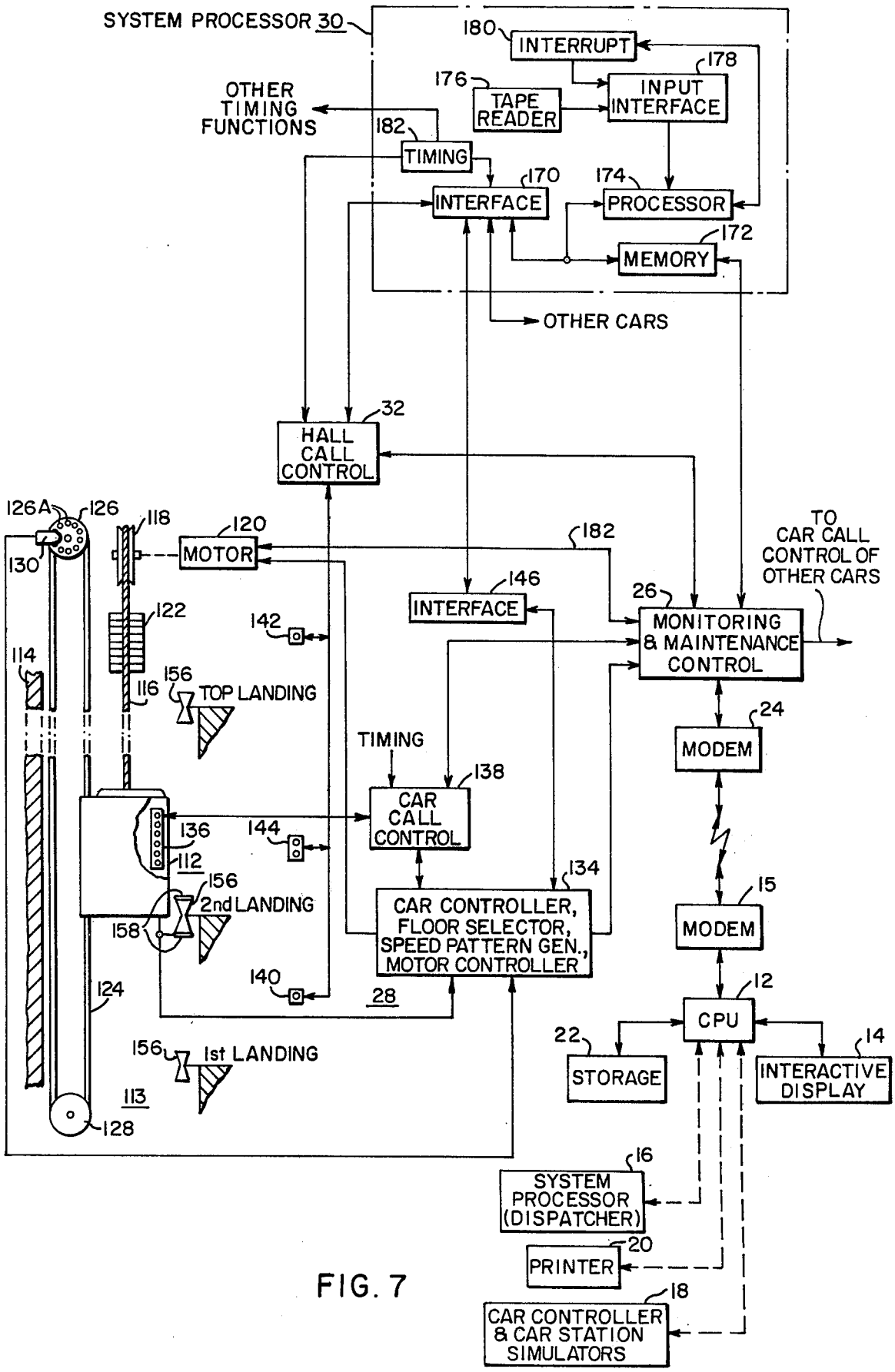
FIG. 7 is a diagram of a monitoring system constructed according to the teachings of the invention, coupled with an elevator system to be monitored.

FIG. 7 illustrates the elevator system 28, in greater detail, in order to set forth monitoring of elevator system parameters andn devices not accessible to the memory of the system processor 30.

The elevator system of FIG. 7 includes a plurality of elevator cars, such as elevator car 112, all controlled by the system processor 30, but since each elevator car and its controls are similar, only the controls for elevator car 112 are illustrated.

Car 112 is mounted in a hatchway 113 for movement relative to a structure 114 having a plurality of landings. The car 112 is supported by a rope 116 which is reeved over a traction sheave 118 mounted on the shaft of a drive motor 120, such as a direct current motor as used in the Ward-Leonard drive system, or in a solid state drive system. A counterweight 122 is connected to the other end of the rope 116. A governor rope 124 which is connected to the top and bottom of the car is reeved over a governor sheave 126 located above the highest point of travel of the car in the hatchway 113, and over a pulley 128 located at the bottom of the hatchway. A pick-up 130 is disposed to detect movement of the car 112 through the effect of circumferentially spaced openings 126A in the governor sheave 126. The openings in the governor sheave are spaced to provide a pulse for each standard increment of travel of the car, such as a pulse for each .5 inch of car travel. Pick-up 130, which may be of any suitable type, such as optical or magnetic, provides pulses in response to the movement of the openings 126A in the governor sheave. Pick-up 130 is connected to control 134 which control includes the car controller, floor selector, speed pattern generator, and motor control. They are grouped together, since they are described in detail in the incorporated patents. Distance pulses may be developed in any other suitable manner, such as by pick-up disposed on the car which cooperates with regularly spaced indicia in the hatchway.

Car calls, as registered by push button array 136 mounted in the car 112, are recorded and serialized in car call control 138, and the resulting serialized car call information is directed to the floor selector of control 134.

Hall calls, as registered by push buttons mounted in the corridors, such as the up push button 140 located at the first landing, the down push button 142 located at the top landing, and the up and down push buttons 144 located at the second and other intermediate landings, are recorded and serialized in hall call control 32. The resulting serialized hall call information is directed to the system processor 30. The system processor 30 directs the hall calls to the cars through an interface circuit, shown generally at 146, to effect efficient service for the various floors of the building and effective use of the cars.

The floor selector of control 134 processes the distance pulses from pick-up 130 to develop information concerning the position of the car 112 in the hatchway 113, and also directs these processed distance pulses to the speed pattern generator portion of control 134, which generates a speed reference signal for the motor controller portion of control 134, which in turn provides the drive voltage for motor 120.

The floor selector keeps track of the car 112 and the calls for service for the car, it provides the request to accelerate signal to the speed pattern generator, and provides the deceleration signal for the speed pattern generator at the precise time required for the car to decelerate according to a predetermined deceleration pattern and stop at a predetermined floor for which a call for service has been registered. The floor selector also provides signals for controlling such auxiliary devices as the door operator and hall lanterns, and it controls the resetting of the car call and hall call controls when a car or hall call has been serviced.

Landing, and leveling of the car at the landing, is accomplished by a hatch transducer system which utilizes inductor plates 156 disposed at each landing, and a transformer 158 disposed on the car 12.

The motor controller portion of control 134 includes a speed regulator responsive to the reference pattern provided by the speed pattern generator. The speed control may be derived from a comparison of the actual speed of the motor and that called for by the reference pattern by using a drag magnet regulator, such as disclosed in U.S. Pat. Nos. 2,874,806 and 3,207,265, which are assigned to the same assignee as the present application. The precision landing system using inductor plates and transformer 158 is described in detail in the latter of these patents.

The programmable system processor 30 includes an interface function 170 for receiving signals from, and sending signals to, the car controllers (interface 146) of the elevator cars in the elevator system, a memory 172 in which a software package is stored, a processor 174 for executing instructions stored in the memory 172 relative to the dispatching of elevator cars and otherwise controlling a group of elevator cars according to software strategy stored in the memory, a tape reader 176, an input interface 178 for transferring the software data from paper tape, or the like, to the memory 172, an interrupt function 180, also connected to the processor 174 via input interface 178, and a timing function 182 for controlling the transmission of data between the system processor 30 and the car controllers of the elevator cars.

Predetermined parameters of the drive motor 120 are checked by suitable transducers, and the conditions of the transducers are monitored by the monitoring and maintenance control 26 via conductors which are shown generally at 182. For example, transducers may monitor bearing temperature, bearing vibration, armature current, motor operating temperature and brush wear.

Landings which are not within a prescribed tolerance are recorded, such as by a counter which receives landing information from suitable landing zone switches which are activated during landing and leveling and operated by an out of range landing. This counter is interrogated and reset by monitoring and maintenance control 26. Additional functions may also be monitored, such as by means which counts the number of times the elevator car is removed from group service and placed on emergency through trip operation.

Figure 8:
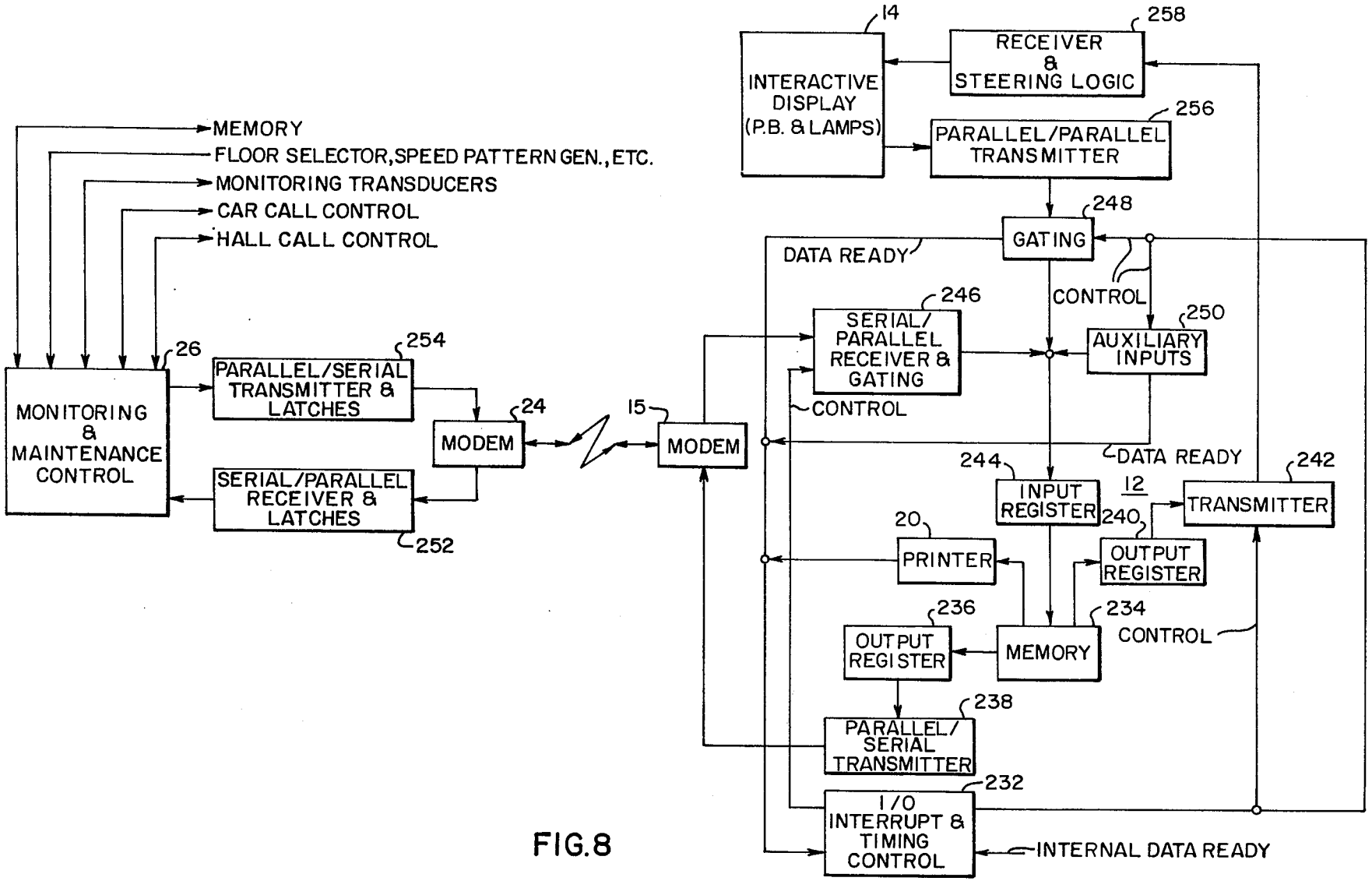
FIG. 8 is a diagram of a remotely located portion of the monitoring system shown in FIG. 7.

FIG. 8 is a block diagram which functionally illustrates the hardware involved in the exchange of information between the elevator system 28 and the remotely located portion of the monitoring system 10. The processor 12 provides the signals which control the transfer of data into and out of the processor 12. The heart of the processor is the I/O interrupt and timing control 232 which receives all input/output requests and provides the signals which control orderly flow of I/O data into and out of the memory 234.

The processor 12 includes a memory 234 which stores all information, including an image of the core map shown in FIG. 3, derived from the system processor of the elevator system being monitored, and an image of the display 14. Data from the memory 234 destined for the elevator system being monitored is sent in parallel to an output register 236, and then to a suitable parallel to serial transmitter 238. Data from the memory 234 destined for the display panel 14 is sent in parallel to an output register 240 and from there to a parallel to parallel transmitter 242. Parallel transmission between the interactive display 14 and the processor 12 may be used, since it is assumed that the display will be located at the same site as the processor 12.

Data for the memory 234 is input via an input register 244. The input register 244 may receive data from many sources. For example, data from the elevator system is received in a serial/parallel receiver and gating arrangement 246, data from the display panel 14 is received in a parallel/parallel receiver and gating arrangement 248, and all other inputs, such as from a keyboard and magnetic tape are lumped into the function 250 entitled "auxiliary inputs".

The elevator system being monitored, in addition to a modem 24, includes a serial/parallel receiver and latch function 252 for receiving information from the central processor 12, and a parallel/serial latch and transmitting function 254 for transmitting information to the central processor 12.

The display panel 14 includes a parallel/parallel transmitter function 256 for sending information to the processor 12, and a parallel/parallel receiver and steering logic function 258 for receiving information from the processor 12.

Data ready signals from the various functions which send data to the memory 234 are directed to the interrupt and timing control 232, and the interrupt and timing function 232 selects whether it is to receive or send data, and the external device that it is to receive data from or to send data to. The signals for controlling the flow of data are referenced "control" in FIG. 8.

Figure 9:
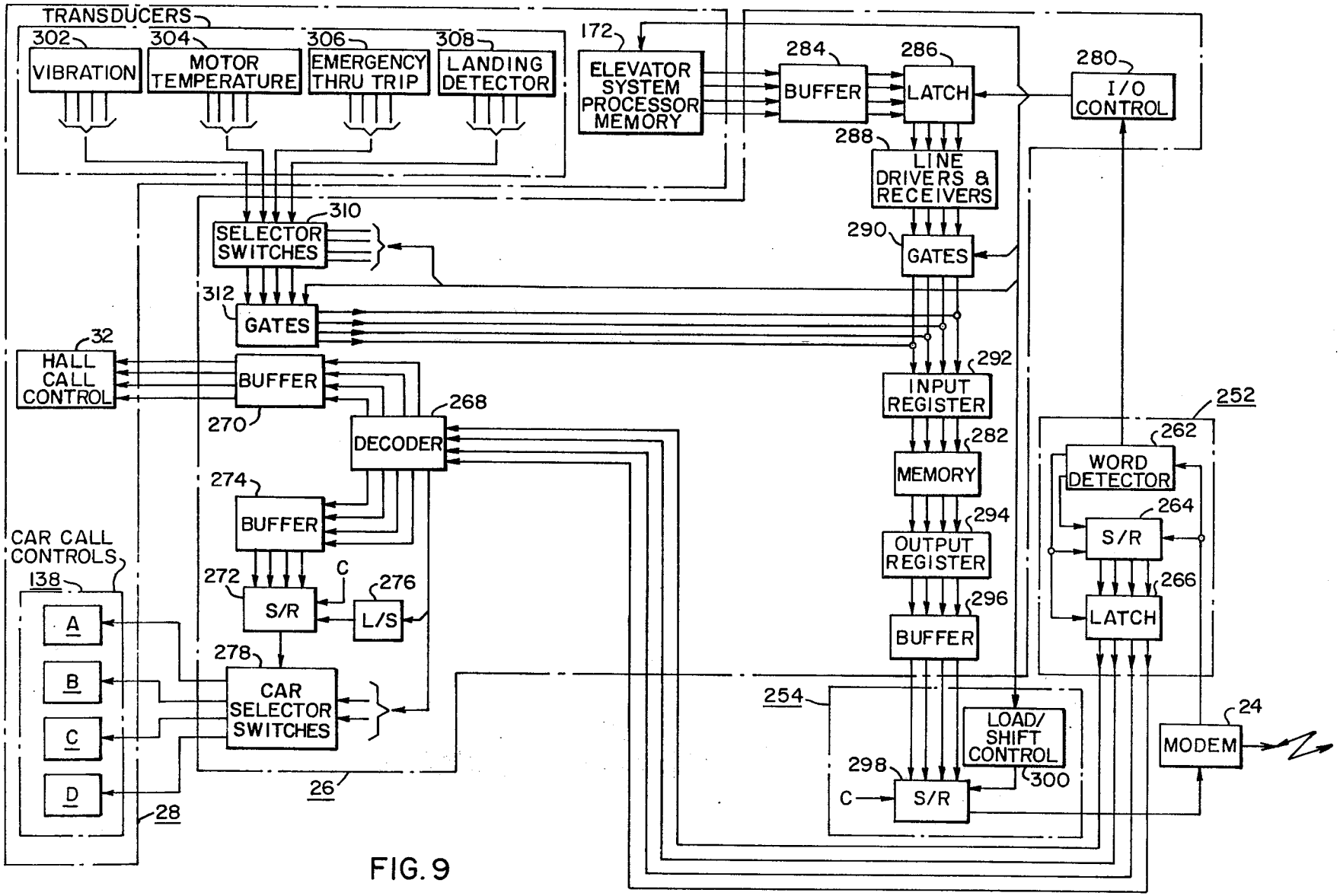
FIG. 9 is a detailed diagram of monitoring and maintenance interface control which may be used for this function shown in block form in FIGS. 7 and 8.

FIG. 9 is a detailed diagram of monitoring and maintenance control 26 which may be used for this function shown in block form in FIGS. 1 and 4–8.

Commands from the remote monitoring station are received as serial, digital words by modem 24 and applied to serial to parallel receiver 252.

Receiver 252 includes a word detector 262, a shift register 264 and a latch 266. Word detector 262 detects a valid word, such as by sensing a zero which precedes a data word, and if a detected word is a traffic command or request, the word detector then provides the clock pulses necessary to clock the correct number of bits into shift register 264. If the parity checks, the word detector 262 strobes the data held in the shift register 264 through the latch 266 to a decoder 268, which decodes the commands and directs them through suitable steering logic to the proper function. If the command is a hall call, the command is directed to hall call control 32 via buffer 270. If the command is a car call, it is directed to a shift register 272 via buffer 274, with load/shift control of the shift register, shown generally at 276, loading and shifting the data out serially to car selector switches 278. The serialized car call information is then directed to the car call control 138 of the selected elevator car.

If the information received by the word detector 262 is not a traffic command but it requests floor data, I/O control 280 controls the transfer of data from the memory 172 of the elevator system processor, as well as from monitoring transducers, to the remote monitoring location. Information from the memory 172, indicated in the core map of FIG. 3, is transferred to memory 282 via buffer 284, latch 286, line drivers and receivers 288, gates 290, and an input register 292. Memory 282 is used in order to store an image of the core map shown in FIG. 3, and after the complete core map is initially sent to the remote monitoring station, only changes in the image of the core map need be sent to the remote monitoring station. The information from memory 282 is transmitted to the remote monitoring station via an output register 294, buffer 296 and a transmitter 254. Transmitter 254 includes a shift register 298 and a load/shift control 300. Transmitter 254 converts the parallel data to a serial mode for transmission over the phone line via modem 24.

The conditions of the elevator system monitoring transducers, such as transducers 302, 304, 306 and 308 for monitoring drive motor bearing vibration, motor and/or bearing temperature, emergency through trip counters, and floor landing counters, respectively, are transmitted to the memory 282 via selector switches 310, gates 312 and input register 292. After the conditions of these transducers are initially sent to the remote monitoring point at the start of the monitoring period, only changes in these conditions need be sent for the remainder of the monitoring period.

In summary, there has been disclosed a new and improved monitoring system for an elevator installation which permits selective off-site monitoring by direct dial telephone communication. The remote monitoring station includes processing means for presenting the data in usable form, including a real time optical display of the operation of the elevator system, and the analyzing of data and printing the results of such analysis. The disclosed monitoring system also includes the ability to remotely enter traffic requests and other commands into the elevator system, for exercising the elevator system during off hours, permitting specific performance checks of hardware and software features. The remote monitoring facility also includes a system processor which may be programmed similar to that of the system processor of the elevator system being monitored, permitting the remote system processor to be substituted for the local system processor for comparison checks, as well as for operating the elevator system with a remote system processor when the local system processor is out of service. The remote monitoring station also includes a car control and car motion simulator which may be programmed with the acceleration and speed of the cars of the elevator system being monitored, and connected to the system processor of the elevator system to check the elevator system processor without actually moving the elevator cars in response thereto.

While the invention has been described using a programmable system processor, it is to be understood that the elevator system to be monitored may include any type of system processor. For example, a relay type system may be monitored using an interface for converting relay closures to logic level-digital words analogous to those shown in the core map of FIG. 3.

We claim as our invention:

1. A monitoring system for remotely monitoring an elevator installation, comprising:

an elevator system including at least one elevator car, and means for operating said elevator car, monitoring means located remotely from said elevator system, means operable from the location of said monitoring means for selectively establishing a communication link between said elevator system and said monitoring means, means associated with said elevator system for sending status signals to said monitoring means over said communication link, said status signals being serial, digital data words responsive to predetermined parameters of said elevator system, said monitoring means including decoding means for decoding the serial data words, and processing means responsive to said decoding means for presenting the information in a predetermined form, control means associated with the monitoring means for initiating predetermined commands to be executed by the elevator system, means for sending command signals to said elevator system over the communication link, with said command signals being serial, digital data words responsive to the commands entered by said control means, and decoding means at the location of the elevator system responsive to the elevator command signals, said decoding means routing commands entering by said control means to the associated functions of said elevator system.

2. A system for monitoring and exercising an elevator installation comprising:

an elevator system including at least one elevator car and means for operating said elevator car, monitoring means, means for selectively establishing a communication link between said elevator system and said monitoring means, means associated with said elevator system for sending status signals to said monitoring means over said communication link, said status signals being in the form of serial, digital data words responsive to predetermined parameters of said elevator system, processing means associated with said monitoring means including decoding means for decoding said data words, and means for presenting the decoded information in a predetermined form, control means associated with said monitoring means for entering commands to be executed by said elevator system, means associated with said monitoring means for sending a command signal to said elevator system over said communication link, said command signal being a serial, digital signal responsive to the commands entered by said control means, and decoding means associated with said elevator system responsive to said command signal, said decoding means routing commands entered by said control means to the associated function of said elevator system.

3. The elevator system of claim 2 wherein the monitoring means includes means for analyzing the status signals, with the means for presenting the decoded information in a predetermined form printing the results of such analysis.

4. The system of claim 2 wherein the means for presenting the decoded information in a predetermined form includes indicating means for visually displaying the current status of the elevator system.

5. A system for monitoring and exercising an elevator installation, comprising:

an elevator system including a plurality of elevator cars, car control means for each of said elevator cars, and first system processor means connected to each of said car control means for controlling the operation of said plurality of elevator cars according to a predetermined strategy, monitoring means including second system processor means, similar to said first system processor means, means for selectively establishing a communication link between said elevator system and said monitoring means, and means substituting the second system processor means for the first system processor means, controlling the operation of said plurality of elevator cars with said second system processing means over said communication link.

6. The system of claim 5 including means associated with the elevator system for sending status signals to the monitoring means over the communication link, processing means associated with the monitoring means including decoding means for decoding said status signals, and means for presenting the decoded information in a predetermined form.

7. The system of claim 6 wherein the means for presenting the decoded information in a predetermined form includes means for analyzing the decoded information and for printing the results of such analysis.

8. The system of claim 6 wherein the means for presenting the decoded information in a predetermined form includes indicating means for visually displaying the current status of the elevator system.

9. The system of claim 5 including control means associated with the monitoring means for entering commands to be executed by the elevator system, means associated with the monitoring means for sending a command signal to the elevator system over the communication link responsive to the commands entered by said control means, and decoding means associated with the elevator system responsive to said command signal, said decoding means routing commands entered by said control means to the associated function of said elevator system.

10. A system for monitoring the system processor of an elevator installation, comprising:

an elevator system including a plurality of elevator cars, car control means for each of said elevator cars, and system processor means connected to each of said car control means for controlling the operation of said plurality of cars according to a predetermined strategy, monitoring means including car control simulation means for simulating each of said car control means, means for selectively establishing a communication link between said elevator system and said monitoring means, means operatively connecting said car control simulation means to said system processor means over said communication link, processing means associated with said monitoring means for presenting, in a predetermined form, the status of the system processor and simulated car control means, and means associated with said monitoring means for entering commands from the system processor and simulated car control means, the results of which are presented by said processing means in a predetermined form.

11. The system of claim 10 wherein the processing means includes indicating means for visually displaying the current status of the system processor and simulated car control means.

* * * * *